US005840450A

United States Patent [19]

Cho

[11] Patent Number: 5,840,450

[45] Date of Patent: Nov. 24, 1998

[54] METHOD FOR FORMING A BLACK MATRIX ON A FACEPLATE PANEL FOR A COLOR CRT

[75] Inventor: Jong-ho Cho, Kwacheon, Rep. of Korea

[73] Assignee: Samsung Display Devices Co., Ltd., Suwon, Rep. of Korea

[21] Appl. No.: 774,094

[22] Filed: Dec. 24, 1996

[51] Int. Cl.[6] ..... G03C 5/00; G03G 13/22; G03G 13/10

[52] U.S. Cl. ..... 430/25; 430/23; 430/28; 430/29; 430/114; 430/118; 430/119

[58] Field of Search ..... 430/25, 23, 28, 430/29, 27, 114, 117, 119, 118; 399/239, 240

[56] References Cited

U.S. PATENT DOCUMENTS

| | | | |
|---|---|---|---|
| 3,096,198 | 7/1963 | Schaffert | 430/119 |
| 4,095,134 | 6/1978 | Strik | 313/470 |
| 4,448,866 | 5/1984 | Olieslagers et al. | 430/24 |
| 4,907,532 | 3/1990 | Mikelsons et al. | 399/239 |
| 5,455,133 | 10/1995 | Gorog et al. | 430/23 |
| 5,519,217 | 5/1996 | Wilbur, Jr. et al. | 430/23 |

FOREIGN PATENT DOCUMENTS 49-42702 11/1974 Japan .

OTHER PUBLICATIONS

Patent & Trademark Office English Translation of JP 49–42702 (Pub Nov. 1974).

*Primary Examiner*—Janis L. Dote
*Attorney, Agent, or Firm*—Christie, Parker & Hale, LLP

[57] ABSTRACT

The black matrix of the faceplate panel is deposited by a wet-layer photoconductive manner. An organic conductive layer is initially deposited on the faceplate panel, on which an organic photoconductive material is formed to form an organic photoconductive layer. The photoconductive layer is charged to positive or negative potential and a selective area of the organic photoconductive layer is exposed to light radiated from an exposure device, such that the potential can be left on the unexposed area, where the black matrix will be deposited, of the organic photoconductive layer. Then, As novel steps, deposition of the conductive black matrix is achieved according to the following steps. First, a conductive black matrix material is charged having the opposite potential to that left on the unexposed area of the organic photoconductive layer. The black matrix material having the opposite potential is then deposited on the outer surface of a developer having a configuration equal to that of the inner surface of the faceplate panel by dipping the developer into the black matrix material. Finally the outer surface of the developer, on which the black matrix material is deposited, contacts the inner surface of the faceplate panel, thereby forming the black matrix on the organic photoconductive layer.

2 Claims, 3 Drawing Sheets

S1

S2

S3

S4

S5

S6

METHOD FOR FORMING A BLACK MATRIX ON A FACEPLATE PANEL FOR A COLOR CRT

FIELD OF THE INVENTION

The present invention relates to a method for forming a black matrix on a screen panel for color CRTs and, more particularly, to a method for depositing a conductive black matrix on a screen panel by using a wet electrophotographic screening process.

BACKGROUND OF THE INVENTION

Generally, a faceplate panel for CRTs is deposited with red(R), green(G), and blue(B) phosphors constituting a phosphor layer of the panel. To allow for the differentiation between the three phosphors and prevent color mixture, thereby increasing color definition, a black matrix is disposed between the phosphors.

There are two different method for forming the black matrix: a wet-layer method using a slurry and a dry-layer method using an electrophotographic screening process.

The wet-layer manner suffers a drawback in that the manufacturing process is complicated. Also, the slurry wed in the process pollutes the environment. Therefore, in recent years, the dry-layer method using an electrophotographic screening process has become widely developed to form the black matrix.

Such a method for forming the black matrix is disclosed in U.S. Pat. No. 5,455,133 to Istvan Gorog et al.

As seen from FIGS. 3 through 8 of the Gorog Patent, a faceplate panel 12 is initially prepared for the deposition of a black matrix 23. Then, the interior surface of the panel 12 is coated with an organic conductive material, 32 on which an organic photoconductive layer 34 is formed.

The organic photoconductive layer 34 is electrostatically charged to a suitable potential using a corona discharge device 38. Then, the shadow mask 25 is disposed in front of the faceplate panel 12 to expose the organic photoconductive layer 34 to light from a light source 42 which projects light through the openings formed in the shadow mask. The light discharges the exposed areas of the organic photoconductive layer 34 where phosphor material will be deposited, but leaves a positive charge on the unexposed area of the organic photoconductive layer 34.

The positively charged area of the organic photoconductive layer 34 is directly developed by depositing thereon negatively charged particles of a black matrix from a developer 44 using a powder spraying method. The black matrix material includes iron manganese oxide, iron cobalt oxide, zinc iron sulfide, and insulating carbon black.

However, when making the black matrix using the above described dry-layer method of the photoconductive screening process, since this black matrix layer is more positively charged than the organic photoconductive layer is in recharging steps of phosphor layer screening process, the higher positive voltage on the black matrix layer repels the positively charged phosphor material which leaves small gaps which are objectionable. Thus, in addition to the organic conductive and organic photoconductive layers 32 and 34 that are required during the process of making the black matrix, as seen from FIGS. 9 and 10 of U.S. Pat. No. 5,455,133, additional conductive and photoconductive layers 132 and 134 are required during a process of making the phosphor layer, thereby increasing the number of needed processes and increasing manufacturing costs due to the high cost of the organic photoconductive material.

SUMMARY OF THE INVENTION

Therefore, the present invention has been made in an effort to solve the above described problems of the conventional batteries.

It is an object of the present invention to provide a method for forming a black matrix of a faceplate panel for CRTs, by which there is no need for additionally depositing the organic conductive and organic photoconductive layers when forming the phosphor layer, thereby simplifying the process for making the screen panel and reducing manufacturing costs.

It is another object of the present invention to provide a method for forming a conductive black matrix to which the voltage can be applied if needed to allow the phosphors to be precisely deposited on the desired position.

The above objects can be achieved by making the black matrix from a conductive material.

According to a feature of the present invention the conductive black matrix is formed by a wet-layer photoconductive method. That is, an organic conductive layer is initially deposited on the faceplate panel, then an organic photoconductive material is formed on the organic conductive layer to form an organic photoconductive layer. The photoconductive layer is charged to positive or negative potential and a selective area of the organic photoconductive layer is exposed to light radiated from an exposure device, such that the potential can be left on the unexposed area where the black matrix will be deposited.

As novel steps, deposition of the conductive black matrix is achieved according to the following steps. First, a conductive black matrix material is charged having an opposite potential to that left on the unexposed area of the organic photoconductive layer. The black matrix material having the opposite potential is then deposited on the outer surface of a developer, which has a configuration equal to that of the inner surface of the faceplate panel, by dipping the developer into the black matrix material contained in the container. Finally the outer surface of the developer, on which the black matrix material is deposited, contacts the inner surface of the faceplate panel, thereby forming the black matrix on the organic photoconductive layer.

Preferably, the black matrix material includes a graphite as a main element thereof.

According to another feature of the present invention, to obtain a more uniform and clean black matrix layer, the developer and the conductive layer are applied with same potential during the deposition of the black matrix on the panel.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF PREFERRED EMBODIMENTS

Figure 1:
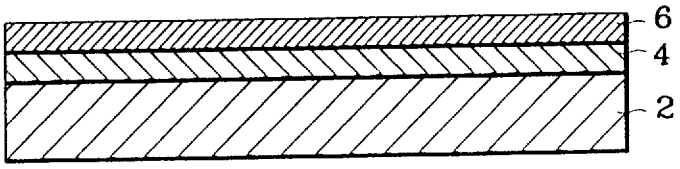
FIG.1(Prior Art)
FIGS. 1 through 3 are sectional views of a screen panel during several conventional steps in a method according to a preferred embodiment of the present invention.

The following is the description of the preferred embodiments according to the present invention. In the drawings, like reference numerals have been used to identify like elements in each figure.

Figure 2:
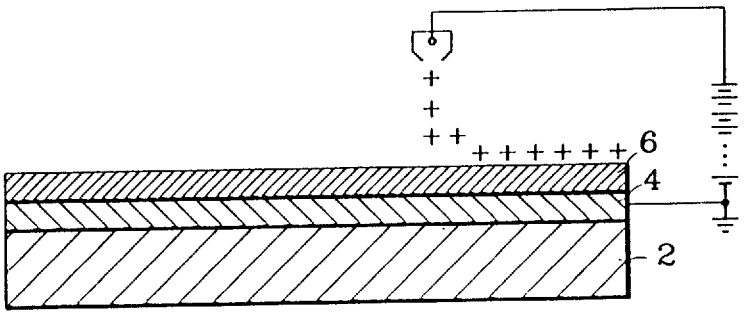
FIG.2(Prior Art)
Figure 3:
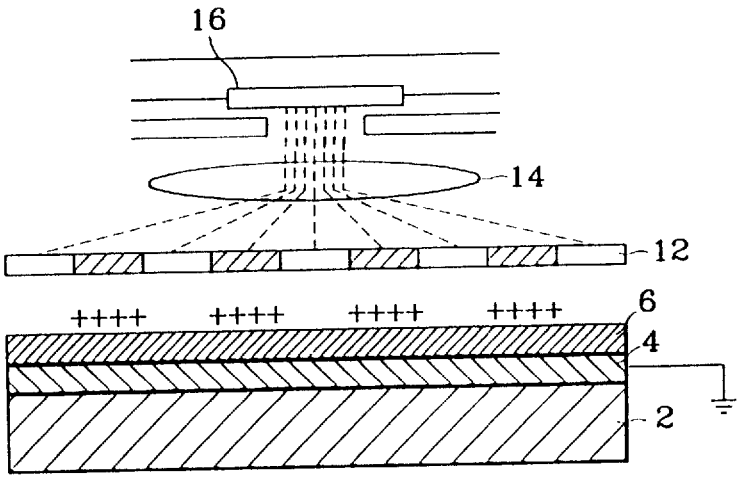
FIG.3(Prior Art)
Figure 4:
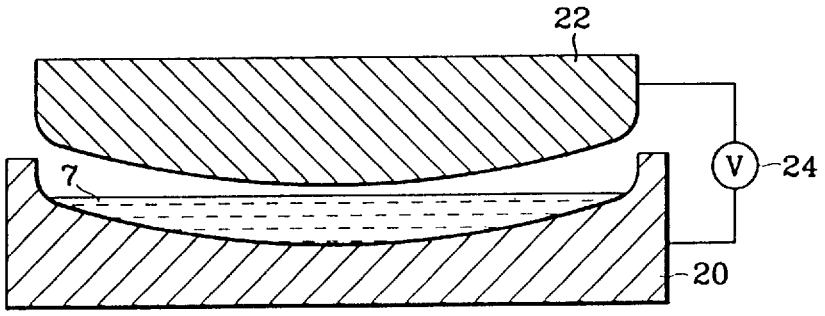
FIGS. 4 through 6 are sectional views of a screen panel during a several inventive steps of a method according to a preferred embodiment of the present invention.
Figure 4:
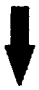
Figure 5:
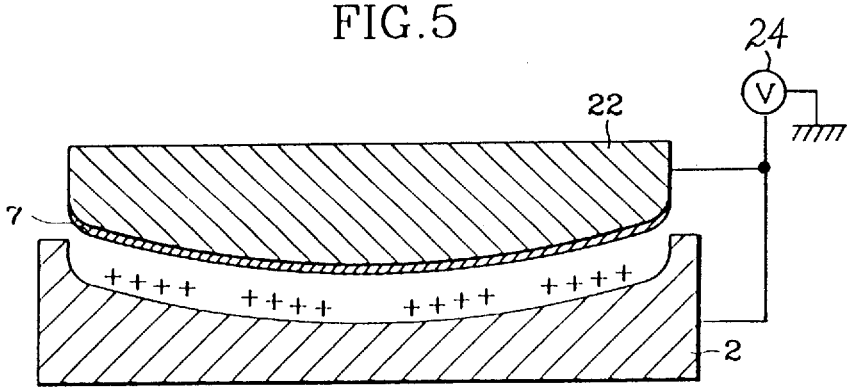
Figure 5:
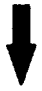
Figure 6:
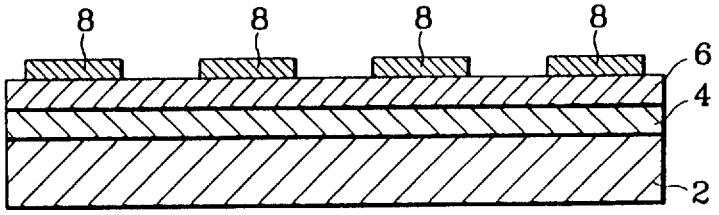

Referring first to FIGS. 1 through 3, there are shown sectional views of a screen panel during several conventional steps in a method according to a preferred embodiment of the present invention. As a first step, an inner surface of a screen panel 2 is coated with an organic conductive layer 4 on which an organic photoconductive layer 6 is formed as shown in FIG. 1. As a second step, in order to form a black matrix, the organic photoconductive layer 6 is electrostatically charged to a suitable positive potential as shown in FIG. 2. In a third step, a shadow mask 12 is disposed in front of the inner surface of the screen panel 12 at a predetermined distance therefrom and the organic photoconductive layer 6 is exposed to light radiated from a light source 16 through an exposure lens 14 and the shadow mask 12, such that the positive charge remains on the unexposed area of the organic photoconductive layer 6 where the black matrix will be deposited. The above-described steps are the same as those of the prior art and the inventive steps will be described hereinafter.

That is, in a fourth step, black matrix material 7, which is charged to negative potential, is uniformly deposited on an outer surface of a developer 22 having a complimentary configuration to that of the inner surface of the faceplate panel 2. That is, there is provided a container 20 containing the black matrix material therein. The container 20 and the developer 22 are connected to a voltage applying apparatus 24 to allow for the application of electricity therein. In this state, the developer 22 is dipped in the black matrix material 7 contained in the container such that the negatively charged black matrix can be deposited on the developer 22. The black matrix material 7 includes a graphite as a main element and additionally includes a high molecular compound, a potential regulator material, and iso paraffin. However, the black matrix material 7 is not limited to these materials and any material can be used as long as they are conductive material and have light absorbing function. Then, in a fifth step, the outer surface of the developer 22 contacts the inner surface of the faceplate panel 2 such that the negatively charged black matrix material 7 deposited on the outer surface of the developer 22 is developed on an area of the positively charged faceplate panel. During this step, if the conductive layer of the panel 2 and the developer 22 can be applied with same potential through the voltage applying apparatus 24, a more uniform and clear black matrix layer can be formed on the inner surface of the panel 2.

Figure 7:
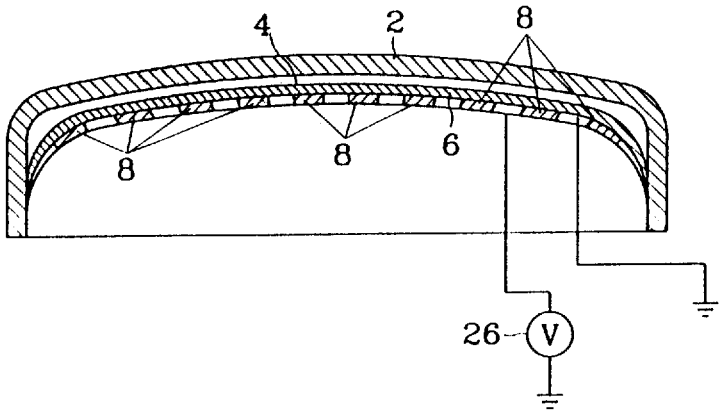
FIG. 7 is a view illustrating a method for forming a phosphor layer on a screen panel on which a black matrix is deposited according to a method of a preferred embodiment of the present invention.

After depositing the black matrix in accordance with the above described present invention, when depositing the phosphor layer on the inner surface on which the black matrix is deposited, processes for depositing an additional organic conductive layer and organic photoconductive layer would not be required since the conductive black matrix layer would repel the phosphor material less than the organic photoconductive layer of conventional processes. That is, as shown in FIG. 7, when depositing each of the R, G, B phosphors, the organic conductive layer 4 is grounded and the black matrix 8 is applied with a certain voltage through the voltage applying apparatus 26 such that the R, G, B phosphors can be precisely deposited at desired positions. For example, if a potential lower than the potential existing on the organic photoconductive layer after depositing the black matrix is applied to the black matrix 8, the phosphors can be completely deposited even on boundaries with the black matrix.

By forming the black matrix in accordance with the above-described method of the present invention, there is no need to deposit an additional organic conductive and organic photoconductive layers when forming the phosphor layer, thereby simplifying the process for making the screen panel and reducing manufacturing costs.

In addition, since the black matrix is conductive, the voltage can be applied thereto when needed, and the phosphors can be precisely deposited on desired positions.

While this invention has been described in connection with what is presently considered to be the most practical and preferred embodiment, it is to be understood that the invention is not limited to the disclosed embodiments, but, on the contrary, is intended to cover various modifications and equivalent methods included within the spirit and scope of the appended claims.

What is claimed is:

1. A method for forming a black matrix on a curved inner surface of a faceplate panel for a color cathode ray tube, said faceplate having an organic conductive layer and an organic photoconductive layer, the method comprising the steps of:

charging the photoconductive layer to a potential;

exposing a portion of the charged photoconductive layer to light in a predetermined pattern, whereby the charge on an unexposed portion remains;

charging a wet conductive black matrix material to an opposite potential to that on the unexposed portion of the photoconductive layer;

depositing the charged black matrix material on an outer surface of a developer, the outer surface having a complimentary configuration to the inner surface of the panel, by dipping the outer surface of the developer into a container of the charged black matrix material; and contacting the outer surface of the developer, on which the charged black matrix material is deposited, with the oppositely charged photoconductive layer on the curved inner surface of the faceplate panel while a same potential is applied to the developer and the conductive layer, whereby the black matrix material is deposited on the unexposed portion of the photoconductive layer.

2. The method of claim 1 wherein the black matrix material includes a graphite.

* * * * *